US009004609B2

(12) United States Patent
Hartwig et al.

(10) Patent No.: US 9,004,609 B2
(45) Date of Patent: Apr. 14, 2015

(54) METHOD AND DEVICE FOR WORKING ROCK

(75) Inventors: Sverker Hartwig, Täby (SE); Gunnar Nord, Sollentuna (SE); Federico Scolari, Milan (IT); Jan Folke Wallenius, Täby (SE); Morgan Norling, Örebro (SE); Kaj Emanuelsson, Viken (SE)

(73) Assignee: Atlas Copco Craelius AB, Marsta (SE)

( * ) Notice: Subject to any disclaimer, the term of this patent is extended or adjusted under 35 U.S.C. 154(b) by 7 days.

(21) Appl. No.: 12/998,456

(22) PCT Filed: Oct. 29, 2009

(86) PCT No.: PCT/SE2009/000478

§ 371 (c)(1),
(2), (4) Date: Apr. 20, 2011

(87) PCT Pub. No.: WO2010/050872

PCT Pub. Date: May 6, 2010

(65) Prior Publication Data

US 2011/0198914 A1 Aug. 18, 2011

(30) Foreign Application Priority Data

Oct. 31, 2008 (SE) ..... 0802316

(51) Int. Cl.
*E21D 9/10* (2006.01)
*E21C 27/24* (2006.01)

(52) U.S. Cl.
CPC ..... *E21C 27/24* (2013.01); *E21D 9/1026* (2013.01)

(58) Field of Classification Search
USPC ..... 299/108, 110, 73, 74, 75, 76, 77, 78
See application file for complete search history.

(56) References Cited

U.S. PATENT DOCUMENTS

| | | | | |
|---|---|---|---|---|
| 3,506,310 | A * | 4/1970 | Gruere | 299/56 |
| 3,860,292 | A | 1/1975 | Bechem | |
| 4,371,210 | A | 2/1983 | Leibee | |
| 4,486,050 | A * | 12/1984 | Snyder | 299/18 |
| 4,548,442 | A * | 10/1985 | Sugden et al. | 299/10 |
| 4,629,010 | A | 12/1986 | Sourice | |
| 4,646,853 | A | 3/1987 | Sugden et al. | |
| 4,721,340 | A | 1/1988 | Wrulich et al. | |
| 5,035,071 | A | 7/1991 | Stotzer et al. | |

(Continued)

FOREIGN PATENT DOCUMENTS

| | | |
|---|---|---|
| AU | 659378 | 5/1993 |
| CH | 677953 A5 | 7/1991 |

(Continued)

*Primary Examiner* — David Bagnell
*Assistant Examiner* — Michael Goodwin
(74) *Attorney, Agent, or Firm* — Mark P. Stone

(57) ABSTRACT

A method for driving tunnels, galleries, shafts or the like with a driving device (1; 2; 15), including: that a cutting head (4) rotating around a general axis of rotation (R) and having cutting elements directed essentially radially outwardly is applied against a rock surface to be worked. The rock cutting elements (13), are formed on cutting rolls (7) are brought to roll against the rock side during pressing against the rock and rotation of the cutting head (4), and the rock cutting elements during rolling are brought to cut sidewardly arranged grooves in the rock surface at a distance from each other. The invention also concerns a rotatable cutting head and a device and a rig for driving tunnels, galleries, shafts or the like.

7 Claims, 11 Drawing Sheets

(56) References Cited

U.S. PATENT DOCUMENTS

| | | | | |
|---|---|---|---|---|
| 5,192,115 | A * | 3/1993 | Hartman et al. | 299/31 |
| 5,333,937 | A | 8/1994 | Hopkins | |
| 5,964,305 | A | 10/1999 | Arzberger et al. | |
| 6,578,926 | B2 | 6/2003 | Bandy, Jr. et al. | |
| 2004/0124691 | A1 * | 7/2004 | Ehler et al. | 299/110 |
| 2009/0322142 | A1 | 12/2009 | Lever et al. | |

FOREIGN PATENT DOCUMENTS

| | | | |
|---|---|---|---|
| EP | 1437445 | A1 | 7/2004 |
| GB | 801615 | * | 9/1958 |
| JP | 10176478 | A | 6/1998 |
| WO | WO 89/05391 | | 6/1989 |
| WO | WO 93/07359 | | 4/1993 |

* cited by examiner

METHOD AND DEVICE FOR WORKING ROCK

FIELD OF THE INVENTION

The invention concerns a method for driving tunnels, galleries, shafts or the like. The invention also concerns a rotatable cutting head for driving of this kind. Further, the invention concerns a rig for such driving.

BACKGROUND OF THE INVENTION

During tunneling as well as mining, the very process of driving tunnels, galleries, shafts or the like is a time consuming, energy consuming and costly element. For completing all these spaces besides the driving, securing roof, floor, walls and possible surface treatment has to be added. During driving of tunnels and galleries, it is previously known to use rigs having cutter wheels, which during working are brought to sweep the rock surface to be worked with the aid of a swingable and pivotable boom and drive arrangement arranged on a carrier vehicle. A rotatable cutter wheel with bar-like working tools is then arranged to carry out rock working.

For driving vertical mining shafts, it is previously known to use reamer bits which are rotated around an axis coinciding with the shaft direction and being pressed against the rock while using a guiding pilot tool.

As a representative of the first category of the background art could be mentioned U.S. Pat. No. 4,721,340. Other representatives of the background art are U.S. Pat. No. 4,629,010 and WO 93/07359 and GB 801 615.

All these representatives of the background art are suffering from the above mentioned drawbacks, namely, time, energy and costs, demanding operation.

AIM AND MOST IMPORTANT FEATURES OF THE INVENTION

An aim of the present invention is to provide a method, a cutting head and a rig as indicated above wherein the drawback of the background art are addressed and at least reduced. This is achieved through the features of the respective independent claims.

It is important to note that the invention concerns working rock by means of a cutting head rotating around a general axis of rotation with the rock cutting element being directed essentially radially outwardly, wherein is intended that the rock cutting elements are positioned distributed around the area of the envelope surface of the cutting head. Further it is intended that the cutting head is applied against a rock surface to be worked by this area of the envelope surface being brought to engagement with the rock.

When it concerns the inventive method, through the invention it is obtained that the amount of rock that has to be disintegrated through direct working through the very rock cutting elements is minimized through the fact that only grooves in the rock side have to be cut through rolling contact with the rock, wherein the grooves lie at a distance from each other, and this in an advantageous and effective way through the features of the cutting head.

Material being present between the grooves will pre-dominantly be split off by itself, because of self induced cracking in the material during groove cutting. Possibly only partly loosened material can thereupon simply be loosened from the worked rock side, for example during next application of the rotational cutting head. Hereby is obtained that the energy consumed for fine disintegrating rock material can be minimized so that time, energy and cost can be reduced.

Further, the very elements working the rock can be used considerably longer as seen per amount of worked rock than in previous, corresponding methods according to the background technology because of the reduction of wear on these elements. Groove width, groove depth and distance between grooves are chosen after application and after the properties of the rock, in particular its susceptibility to form cracks. These parameters can be determined during field tests, practical analysis and/or through laboratory tests and calculations. During dimensioning, of course also the resistance of the rock cutting elements and chosen material for these are of greatest importance, since the thickness of the rock cutting elements is directly determining of the width of the formed grooves. The material in a cutting roll is otherwise per se known high resistance material used previously for similar applications. A cutting roll can also be equipped with hard metal inlays distributed around the circumference.

The fact that only rock material in the area of the grooves intended for being formed will have to be disintegrated is achieved in that the rock cutting elements are formed as at least partially disc shaped cutting rolls, which are brought to roll against the rock side during pressing against the rock and rotation of a cutting head, and that they during rolling are brought to cut sideways arranged grooves that lie at a distance from each other. Hereby is intended that the cutting rolls are essentially disc shaped or partially peripherally essentially disc shaped, wherein it is intended that they should be flat, essentially circular with generally the same thickness, at least peripherally. Hereby it is achieved that grooves are formed which have essentially the same width over the depth of the grooves in the rock side, whereby material between the grooves thereby do not have to be disintegrated, which brings about the above mentioned advantages both as concerns energy consumption and as concerns wear on the rock cutting rock working element.

In particular it is preferred that the cutting head is pressed linearly against the rock to be worked, and on demand, after a completed working phase, the cutting head is drawn away from the rock, moved to a new place with new rock to be worked whereupon the method is repeated in a subsequent working phase. In a rig that allows displacement of the cutting head sideways and up and down, respectively, to a position with new rock, it is made possible to achieve an almost rectangular section of the formed gallery or shaft. In a rig that has pivotal displacement of the cutting head to a place with new rock it is made possible to achieve almost circular section of the produced gallery or shaft.

It is also possible to work rock according to the invention by pressing the cutting head against the rock during a swing movement of the cutting head around the swing axis which is parallel to its general axis of rotation. Hereby is achieved, corresponding to the above, namely, that laterally arranged grooves that are positioned at a distance from each other are cut into the rock.

Normally for vertical shafts and certain tunnel driving and the like, the rotating cutting head is pressed in a direction essentially at a right angle to the general axis or rotation against a rock surface to be worked.

For a certain type of tunnel driving it is, however, very advantageous that the position of a cutting head axis be swung in a direction which forms an angle of between 70° and 90° to a general axis of rotation against a rock surface to be worked. This can be of interest for example during gallery or tunnel driving when a rig is being used which provides pressing of the cutting head in a direction corresponding to the gallery or tunnel direction also with the cutting head being angled outwardly. Because of the geometry hereby, also in most swinged-out position, usually 12°-15° and upwardly to about 20°, a path of a cutting roll is to deviate so little from a groove formed by previous rolls in a group that the above discussed and desired effect will occur anyway. Values somewhat about 20° are not excluded in this connection.

In a particularly preferred embodiment, a plurality of cutting heads are evenly distributed around a central axis and are simultaneously pressed against the rock. This embodiment is intended for in particular shaft driving with the aid of the force of gravity but can also be used for tunneling and shaft driving. During shaft driving, equipment for performing this method is successively lowered through the rock during working of the same. By bringing the cutting heads to rotate simultaneously in opposite direction and inwardly respectively, preferably with the front cutting rolls being driven with a direction inwardly, against said central axis, side forces generated from the different cutting heads could be brought to balance each other. The corresponding balance is achieved if more than two operative cutting heads during rotational brought to swing simultaneously against said central axis.

At occasions, partly stuck material between the cut grooves are loosened through mechanical actuation, for example with scrapes and buckets positioned on or at the cutting head in the area of the cutting roads. All together loosened material is thereupon brought away in a per se known manner through for example elevators, conveyer belts or through other lifting devices, baskets etc. or in any other suitable manner.

When it comes to shaft driving, worked material is suitably transported away through an opening going axially through the driving device, wherein some transport arrangement of the above mentioned kind can be operative.

In particular it is preferred that a force applied for pressing the cutting head against the rock is controlled as a function of one from the group: applied torque for rotation of the cutting head, applied effect for rotation of the cutting head. Hereby is insured that the driving efficiency is held at a height level. Particularly preferred for this purposes is that one from the group, applied torque for rotation of the cutting head, applied effect for rotation of the cutting head is controlled in the direction of maximizing. Hereby wear, working life, power consumption etc. should be considered.

A rotational cutting head according to the invention is formed such that pressing against a rock surface and rotation thereof makes the cutting rolls to roll against the rock side during cutting of said laterally arranged grooves that are lying at a distance from each other. The rock cutting elements are formed as at least peripherally disc shaped cutting rolls which are rotatable around respective roll rotation shafts, the orientation of which being such that the cutting rolls are able to roll against the rock side during pressing against the rock side and rotation of the cutting head, and the rock cutting elements are positioned and arranged laterally with respect to each other such that they during rolling against the rock surface are brought to cut grooves that are arranged laterally at a distance from each other in the rock surface. The operation with an inventive cutting head gives the possibility of creating effective energy saving working as is addressed above.

The roll rotation shafts for at least a part of the cutting rolls are suitably parallel with the general axis of rotation, but it can occur, in particular for cutting rolls positioned more at the sides of the cutting head, that the roll rotation shafts form an angle with the general axis of rotation. In particular the cutting rolls on the cutting head preferably form a profile which deviates from a cylinder and such that the cutting head generally can be seen with a rounded profile, for example as a part of sphere. The cutting rolls at the outer sides of the cutting head are suitably angled somewhat more at the sides so that there active cutting surfaces reach axially outside fastening ears, cutting head sides etc for facilitating contact with unworked rock sidewardly and avoid that the cutting head gets stuck. As an example, the angle between the roll shafts and the general axis of rotation can amount to above 45°. The angle is, however, not usually below this value. In these areas the rolls can be arranged in rows or groups with smaller distance than what is stated above, for example about 20 mm.

It is to be understood that in general the cutting head is shaped as a body with plane sides or at least with sides without any cutting rolls, since the greatest working effect is achieved through essentially linearly disposed cutting rolls having their shafts being parallel with the general axis of rotation. However, rounded cutting heads can be suitable when it comes to tunneling or gallery driving, wherein the shape or the cutting head can be such that an even circular cavity section results from diving according to the invention.

The rock cutting elements are preferably comprised of any one from the group: rolls in the form of discs having essentially circular circumference, rolls with radially protruding, and peripheral disc portions with essentially circular circumference.

The rock cutting elements are thus shaped such that at least the portions engaging the rock are formed as discs or portions of discs with essentially circular circumference as is discussed above. It is also possible to shape cutting rolls with combined, laterally arranged rock cutting elements in the form of radially protruding disc portions having circular circumference. It is also not excluded that the disc somewhat deviates from circular shape and have for example slightly toothed periphery. Suitable material can be a high resistance steel material possibly provided with hard metal buttons distributed around the circumference.

The cutting head according to the invention preferably has peripherally in the area of the cutting rolls arranged material scrapes for loosening partly stuck rock material.

A device for driving tunnels, galleries, shafts or the like includes a carrying unit for carrying, rotation and displacing an inventive cutting head. In particular such a device includes a carrier boom, a rotation unit for rotation of the cutting head and a swing joint, which has a swing axis being parallel to the general axis of rotation. Further it includes a swing motor for swinging of the carrier boom, in particular a hydraulic cylinder. Since the boom is extendable and includes an extension motor, in particular a hydraulic cylinder, it is in a simple manner provided a possibility of achieving the linear pressing force of the device. It is hereby preferred that the boom is telescopically extendable.

The invention also concerns a rig for driving tunnels, galleries, shafts or the like, wherein the rig besides an inventive device for driving also includes a base unit.

A rig according to the invention for driving tunnels, galleries, shafts or the like includes a base unit having: stabilizing units or stabilizing engagement with at least any one from the group: a floor, first side wall, a second side wall, a roof, a pressing unit for at least one rotatable cutting head against rock to be worked, and drive means for rotational driving of said cutting head, wherein the rig provides means or transporting away material being loosened through cutting. The rig includes said inventive cutting head and said pressing unit is arranged for pressing in a pressing direction of said cutting head against the rock during rotation of the cutting head such that rock cutting elements that are arranged on said cutting head are brought to roll against the rock side during forming of laterally positioned grooves that are lying at a distance from each other in the rock side.

Preferably the base unit is a mobile vehicle and the pressing unit is operative in a general direction of the base unit.

The base unit preferably carries said cutting head over a support unit, whereon a carrying unit is displaceable in an angled direction through a side swinging device such that the general axis of rotation will form angles between about 70° and 90° to the pressing direction.

The support unit provides opposite circular arc-shaped guide grooves on opposite edges for displaceable reception of guide elements of the carrying unit.

Stabilizing units acting vertically against a floor and a roof respectively are suitably arranged for lifting the base unit from a first working position for working on a lower level to a second working position for operation on a higher level.

The base unit preferably is provided with a rear extendable/shortenable telescopic unit besides the pressing unit and arranged behind this, as seen in the pressing direction; said telescopic unit allows extra elongation/shortening of the total length of the base unit.

The stabilizing units preferably include front and rear stabilizing units, wherein the base unit preferably is provided with a joint in the area of the rear stabilizing units for the purpose of enhancing the maneuverability of the rig in narrow passages.

In one embodiment of the invention the base unit includes a rotation unit for each carrying unit for rotation around a rotational axis being at a right angle to the swing axis of the respective carrying unit. Here it is in respect of a rig that can be provided with one or more booms being provided with cutting heads according to the invention, which individually or simultaneously can be brought against a rock side to be worked. Hereby a greater width and height respectively can be achieved of the resulting tunnel or gallery. Hereby suitably the base unit is a mobile vehicle which includes stabilizing units for stabilizing engagement with at least one of: a floor, a first side wall, a second side wall or a roof.

In order to make it possible to drive tunnels, galleries, shafts or the like according to the invention, a rig that is used for the purpose needs sufficient stability and precision in order for the cutting head not to wobble forth and back during the operation. This is achieved on the one hand by the very rig itself being sufficient rigidity, on the other hand that it has operative stabilizing units according to the above so that the rig can be fixed in a stable manner in respect of the rock to be worked. Hereby is achieved by the one hand that a sufficiently great pressure force can be applied to the cutting head during the drift, on the other hand that the cutting can be preformed with sufficient precession since it is avoided that the rig moves in a non desired manner during the drift.

In a particularly embodiment, wherein the base unit includes a plurality of carrying units, these are evenly distributed around the central axis of the base unit. This results in a plurality of advantages of the invention where one is that the ability to move forward of such a rig can be higher. Suitably the base unit is mobile by being stepwise movable forward by means of two mutually displaceable step units each one capable of being stabilized against surrounding rock sides.

Working of the rock can be controlled through a CPU connected to the rig so that movements and forces are adjusted in a manner which is advantageous for the working operation. Further features and advantages of the invention are objects of further claims and will come clear from the below detailed description of embodiments.

BRIEF DESCRIPTION OF DRAWINGS

The invention will now be described in greater detail by way of embodiments and with reference to the annexed drawings, wherein.

DESCRIPTION OF EMBODIMENTS

Like and similar elements have partly been provided with the same reference numbers.

Figure 1A:
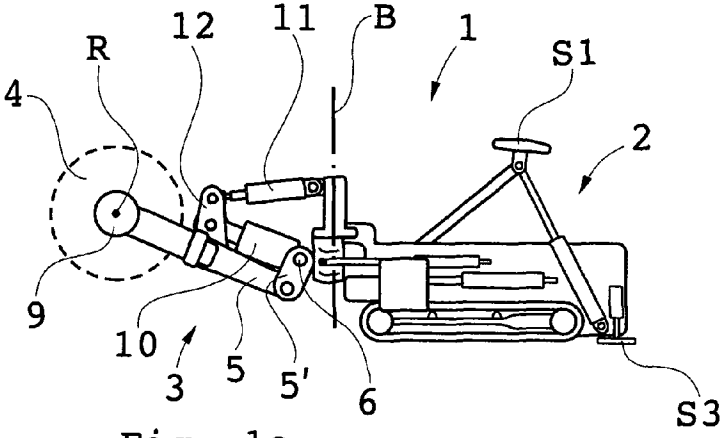
FIG. 1*a* shows a rig according to the invention in a side view.
Figure 1B:
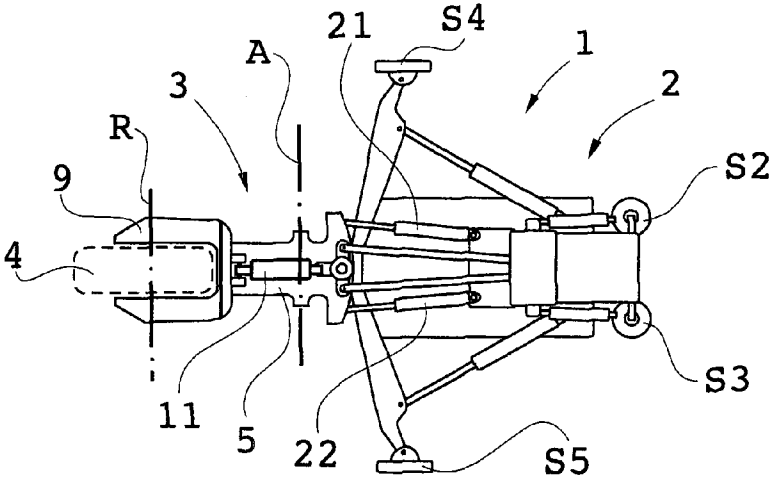
FIG. 1*b* shows the rig in FIG. 1*a* in a view as seen from above.

The working rig 1 in FIGS. 1*a* and 1*b* is mainly intended for driving essentially horizontal tunnels and galleries and has a base unit 2 with crawler bands for moving forward and (not shown: driving motor, transmission, drive means for the working equipment and control means).

The base unit has on a front side a carrying unit 3 for a cutting head 4 said carrying unit having a carrying boom 5, which over an arrangement with the link 5' and a swing joint 6 having a horizontal swing axis A is connected to a swinging arrangement for swinging the carrying unit 3 in a horizontal plane around a vertical swing axis B. The boom arrangement 5, 5' is in the shown example extendable through an actuation cylinder 10.

For the purpose of swinging, the working rig 1 has two sideward positioned swing cylinders 21, 22 comprising a swing motor arrangement for the carrying unit 3. The cutting head 4 is supported on the free end of the carrying unit 3 and is with a main body extended and rotatable around a general axis or rotation R in the area of an end part of the carrying unit 3, which has a bearing region 9 for including a (not shown) rotation motor with a transmission for the cooperation with a drive shaft of the cutting head 4.

Radially and peripherally on the cutting head 4 are arranged, distributed over the perimeter and width, a number of cutting rolls 7 (see FIG. 2) or rock cutting elements having circular, disc shaped periphery, which will be described in detail below. At rotation of the cutting head 4 and simultaneous pressing of the cutting head 4 against a rock side to be worked, hereby there are grooves cut in the rock, grooves that are arranged laterally at a distance from each other. The rock cutting elements are thus arranged at an axial distance from each other, which is determined from the properties of the rock such as hardness of the rock, the ability of the rock to form cracks etc. For pressing of the cutting head 4 against the rock to be worked, the cutting head 4 is normally pressed essentially in directions that are at a right angle to the general axis of rotation R against the rock. This way there are generated said parallel grooves with intermediate areas of material which are easily chipped away and thus do not have to be subject of energy demanding working. For this purpose the carrying unit 3 is, as stated above, provided with an arrangement for being extendable, in this embodiment in particular with two link portions, with the aid of a hydraulic motor in the form of an actuation cylinder or pushing cylinder 10 which is arranged for action on the boom 5.

It is, however, not excluded that pressing is obtained by swinging cutting head 4 against the rock side to be worked, still in directions normally essentially at a right angle to the general axis of rotation R. For this purpose can be used a swing cylinder 11, being arranged between the boom 5 and the base unit 2, in particularly between a fastening ear 12 and an upper portion of a column-shaped element on the base unit.

The swing arrangement with the swing cylinder 11 and swing joint 6 is otherwise used for relocating the cutting head 4 to new portions of the rock to be worked and with the swing arrangement and the swing device, the cutting head can be maneuvered in order to cover a great area in a tunnel or a gallery to be drifted.

For stabilizing the base unit 2 during drifting operation it is provided with an arrangement with stabilizing units, whereof the stabilizing unit S1 acts against the roof of the tunnel or the gallery wherein the driving is in operation, the stabilizing units S2 and S3 act against the floor of the tunnel of the gallery and the stabilizing units S4 and S5 act against the side walls. S1, S4 and S5 are arrangements with pivotal arms which are maneuverable with cylinders, and which are pivotally connected to the base unit and also pivotally connected to pressure plates for engagement with walls and roof respectively. S2 and S3 are jack-like support units that are built into the base unit.

Figure 2:
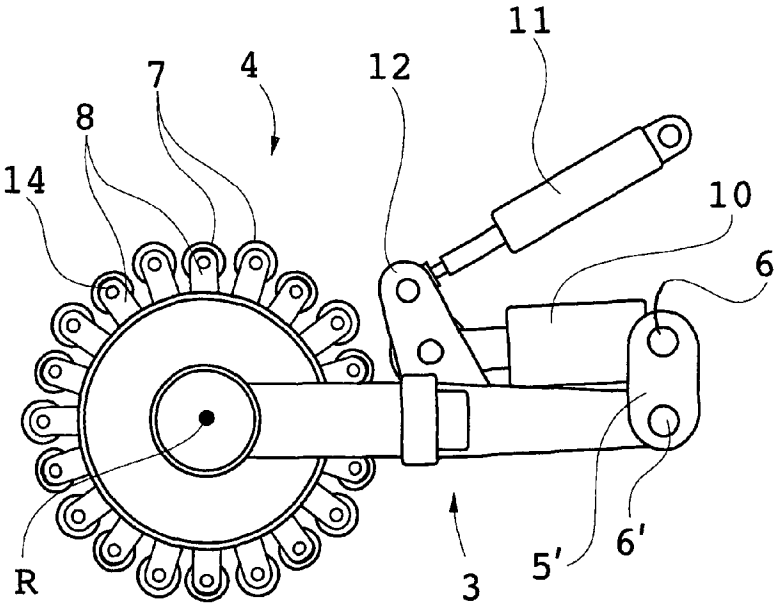
FIG. 2 shows a working module in the form of a carrying unit with cutting head in the side view.

In FIG. 2 is shown a carrying unit 3 of FIGS. 1*a*-1*b* in greater detail. The carrying unit 3 is modular with a supported cutting head 4 and arrangement for fastening to a base unit (not shown) of any kind.

The cutting head 4 being supported by the carrying unit 3 is in this case provided with cutting rolls 7 in axially sideways displaced groups. The cutting rolls 7 are rotatable around roll shafts 14 such that their roll rotation axes in certain cases are parallel to the general axis or rotation axis R, in certain cases form an angle to the general axis or a rotation R. During rotation, the cutting head 4 in this case describes with its central portion essentially a cylindrical rotational body.

The rolls 7 have at least radially most outwardly disc-shaped configuration for cutting of grooves at a mutual distance according to the above.

The cutting rolls 7 are in the shown example positioned such that the cutting head 4 receives a rounded form as seen in a direction at a right angle to the general axis of rotation R, against the sides of the cutting head, with the cutting rolls 7 in the central area of the cutting head being carried by roll shafts such that their roll rotation axes are parallel to the general axis of rotation R whereas the sideward positioned cutting rolls are supported by shafts such that the roll rotational axes of these cutting rolls form an angle to the general axis of rotation R. The rolls 7 are carried by fastening ears 8, which have recesses for said roll shafts 14.

As an alternative, each cutting roll 7 can include a plurality of rock cutting elements being arranged sideward and at a distance from each other and forming disc shaped portions.

Figure 3C:
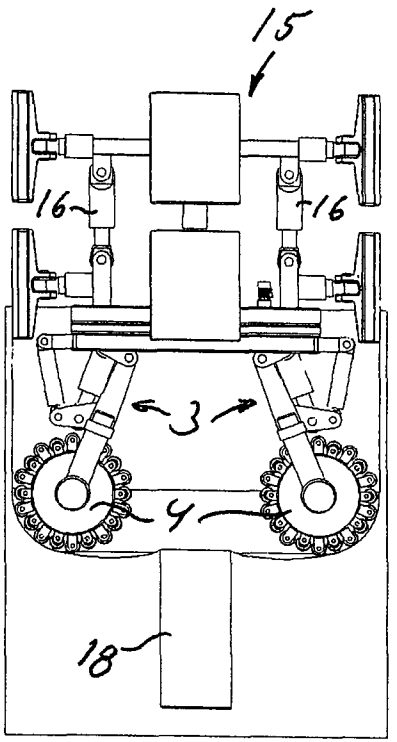
FIGS. 3*a-c* shows a working rig for driving shafts according to a second embodiment in different positions.
Figure 3B:
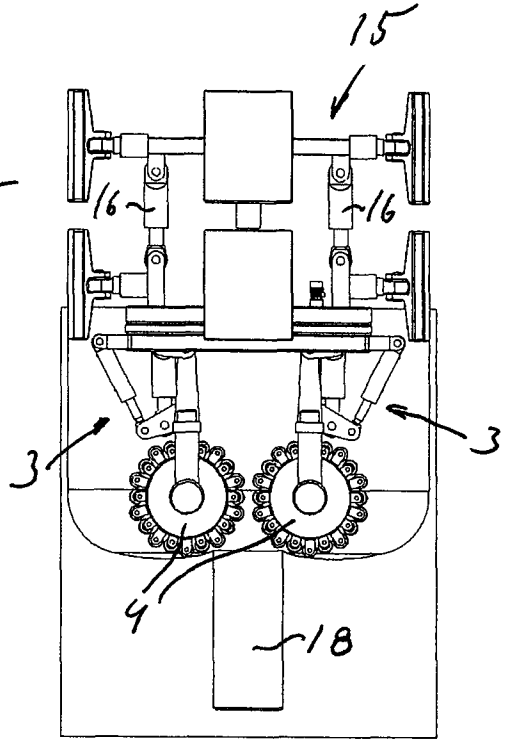
Figure 3A:
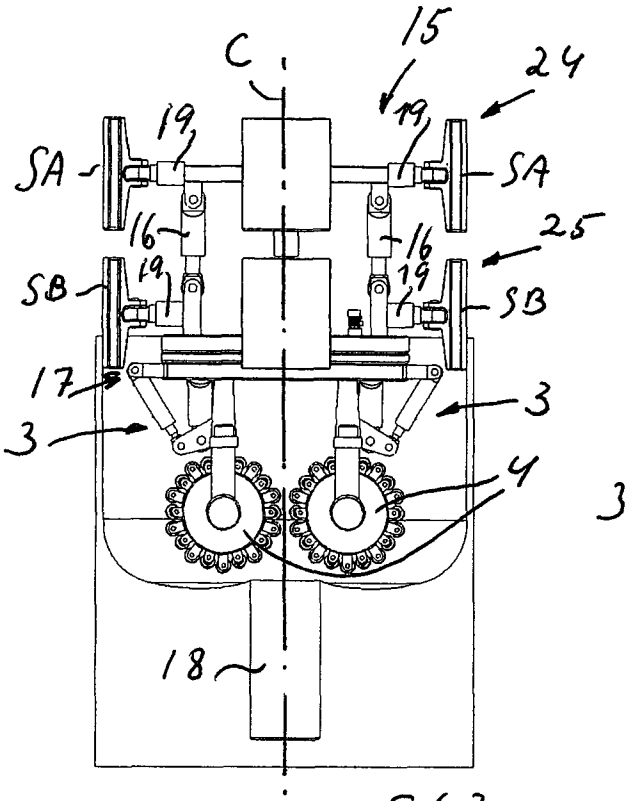

FIGS. 3*a*-*c* show another embodiment of the invention, in particular but not exclusively for driving shafts vertically. Two cutting heads 4 are supported by the base unit 15, which includes two stepping units 24, 25, which are mutually interconnected by a set of controllable distance units 16. The stepping units 24 and 25 have each four stabilizing units, SA and SB respectively which are distributed around a central axis C of the base unit and being maneuverable such that the base unit is stepwise moveable forward by activating/deactivating of pressing means that effect the stabilizing units in the form of cylinders 19 and the distance units 16 in a per se known manner.

A chassis portion with rotator function of the base unit is indicated with 17, and on this chassis portion 17 is arranged, opposite to each other, two carrying units 3 for each one cutting head 4. The carrying units 3 essentially correspond to the carrying unit being shown in FIG. 2 and these are constructed modularly and suitably arranged to be driven simultaneously with opposite directions of rotation such that side forces occurring during the driving through pressing the cutting heads 4 against rock to be worked are balanced against each other.

In FIGS. 3*a*-*c* is further shown a working sequence, wherein in FIG. 3*a* the cutting rolls are shown lifted from the rocks, in FIG. 3*b* the cutting rolls are shown linearly brought down from the positioning in FIG. 3*a* to a position engaging and working the rock. In FIG. 3*c*, the carrying units are swinged outwardly such that the cutting rolls engage a new rock region to be worked.

Pressing the cutting rolls in the shown embodiment can be had in three different ways, namely, beside as is stated above by way of the extendable boom with the associated extension cylinder and by swinging the carrying unit also by pressing by means of the distance units 16, and it is normally the latter which is the most effective for the rig.

After working rock in an axial section of the shaft, a carrying units 3 with associated cutting heads lifted from engagement with the rock can be rotated around the central axis C to a new position of renewed pressing and drifting by means of the rotator function through rotation of a lower ring of the chassis portion 17.

Reference numeral 18 indicates a pilot hole which preferably is drilled for guiding the shaft driving. This pilot hole 18 is used for example also for temporal collecting worked rock material and can as an example be a space for a basket, which can be sunk and into which worked material can be continuously collected. When the basket is full it can be taken up to a tipping station for the material and thereupon be relocated to the pilot hole. Worked material can also be transported away in any other way by means of scrapes, elevators etc.

Figure 4:
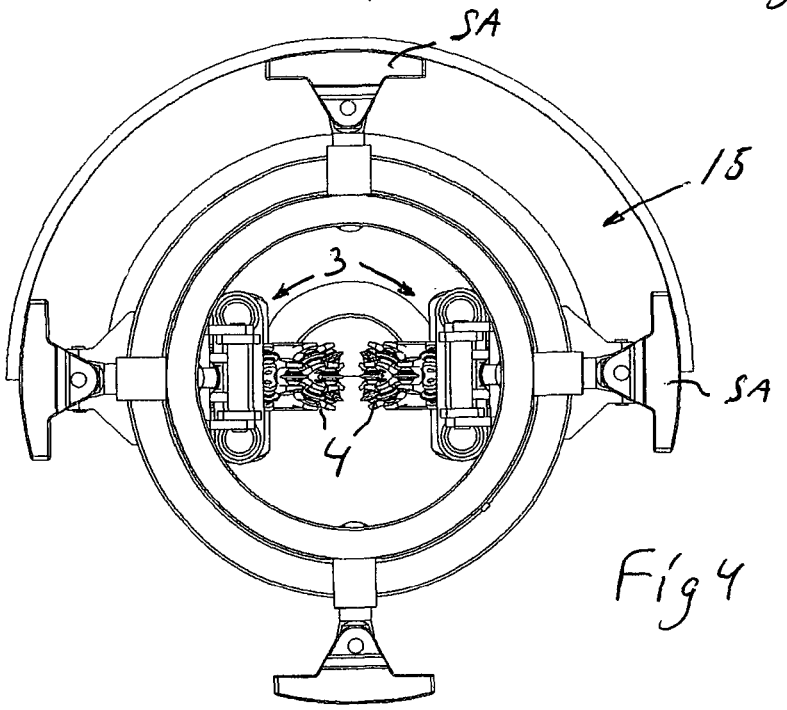
FIG. 4 shows the rig in FIGS. 3*a-c* as seen from the above.

FIG. 4 shows the device of FIG. 3*a*-*c* from above. Hereby is made clear that it is centrally open which allows discharge of worked material vertically upwardly through the device.

Figure 5A:
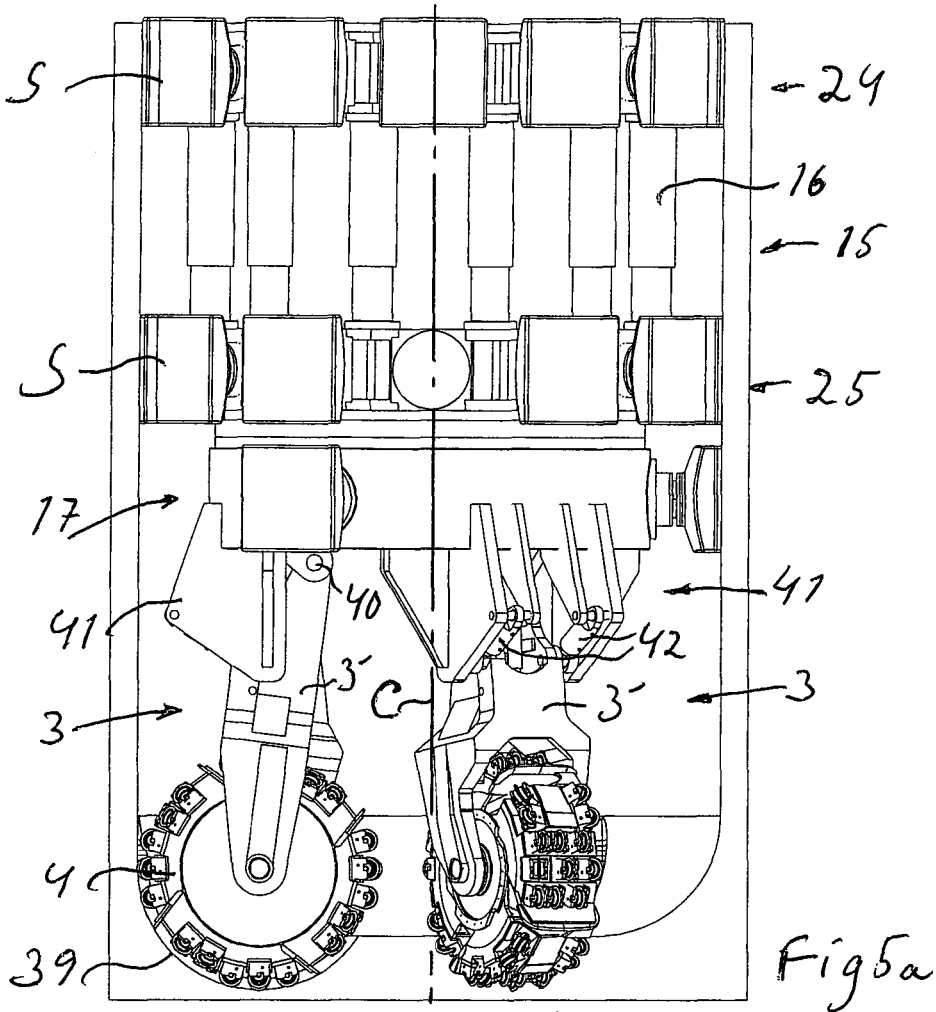
FIGS. 5*a-c* shows a working rig for driving shafts according to further embodiments in different views.

Yet another embodiment of the invention for in particular but not exclusively shaft driving vertically is shown in FIG. 5*a*. In this case three cutting heads 4 (whereof two are shown in FIG. 5*a*) are evenly distributed around the central axis C. At simultaneous pressing and rotation of the cutting heads, in operation of the device, balancing of occurring forces corresponding to what is stated above is obtained.

The carrying unit 15 also in this case has two stepping units 24, 25, which are mutually interconnected through a set of controllable distance units 16. The stepping unit 24, 25 has in this case a greater number of applyable stabilizing units S, namely each have twelve. Corresponding to what is described above there is also arranged a rotator function for a chassis portion 17, whereon are arranged three carrying units 3 for each one cutting head 4. The device in FIG. 5*a* is shown with the distance unit 16 in an expanded state and with the cutting heads 4 in a pressed down state by means of these distance units 16 such that the recesses 39 have been made in rock.

Carrying units 3 are here constructed with a swingable boom part 3' which is swingable in radial direction for the device, with the cutting heads 4 around a swing axis 40 in the area of the chassis portion 17. A counter-acting arrangement 41 is arranged rigidly joint to the chassis portion 17 for holding hydraulic cylinders 42 maneuvering the carrying unit 3.

Figure 5C:
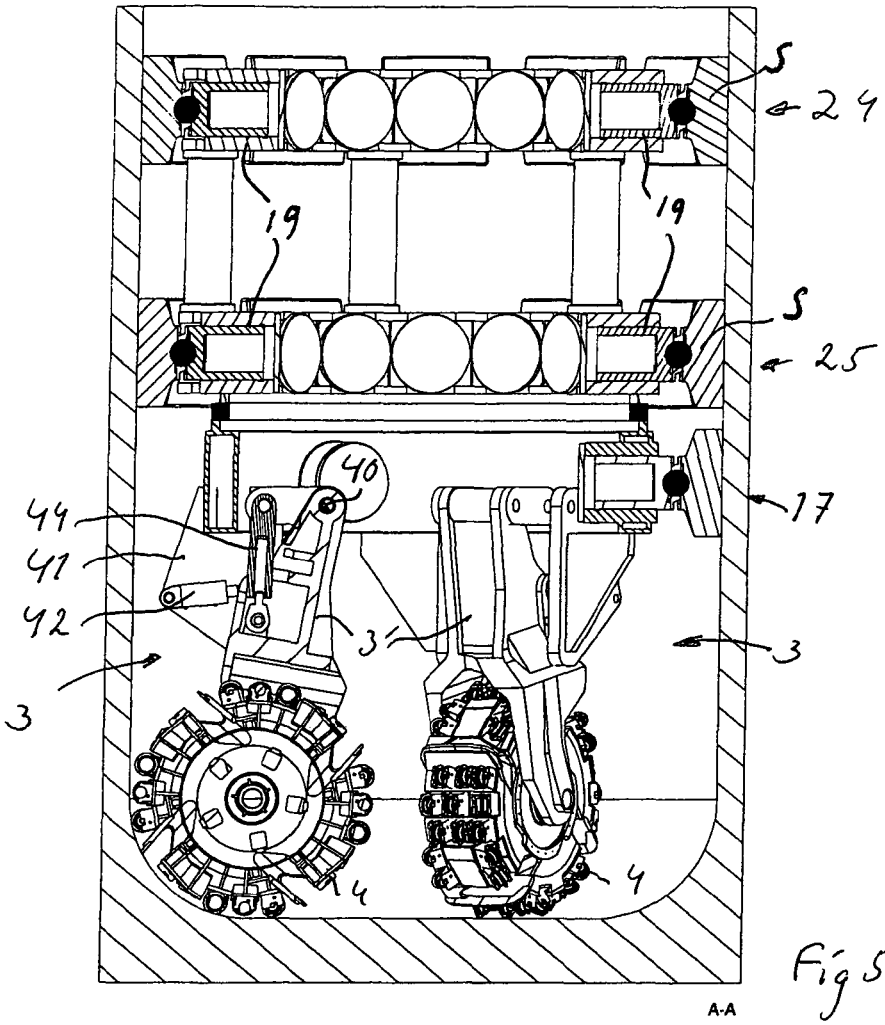
Figure 5B:
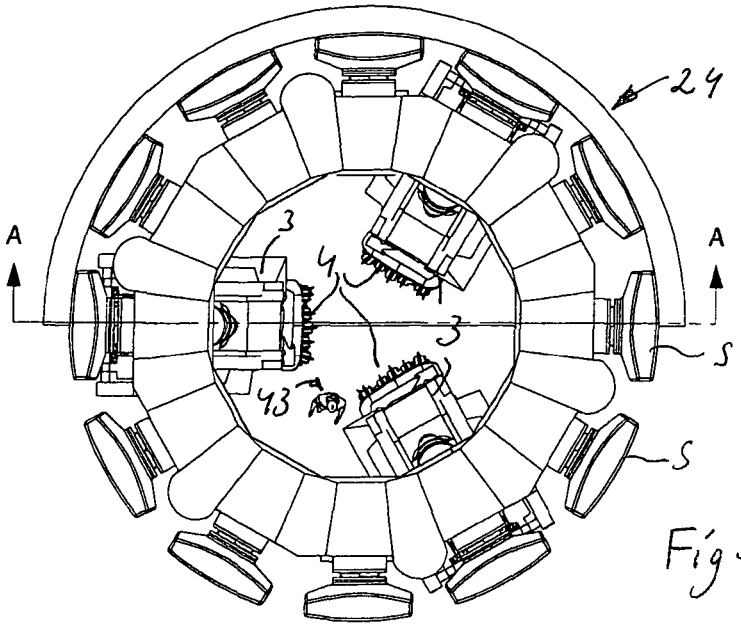

FIG. 5*b* shows the device in FIG. 5*a* from above with the upper stepping unit 24 shown almost ring shaped with its twelve stabilizing units S applied against walls of a shaft. 43 indicate, for understanding of prevailing dimensions, a human being of normal size.

FIG. 5*c* shows the device in FIG. 5*b* along the section A—A in this Figure, wherein the stepping units 24 and 25 are shown with each a pair of pressing means 19 for stabilizing units S shown in section. 44 indicates a hydraulic cylinder for push-maneuvering the carrying unit 3.

Figure 6A:
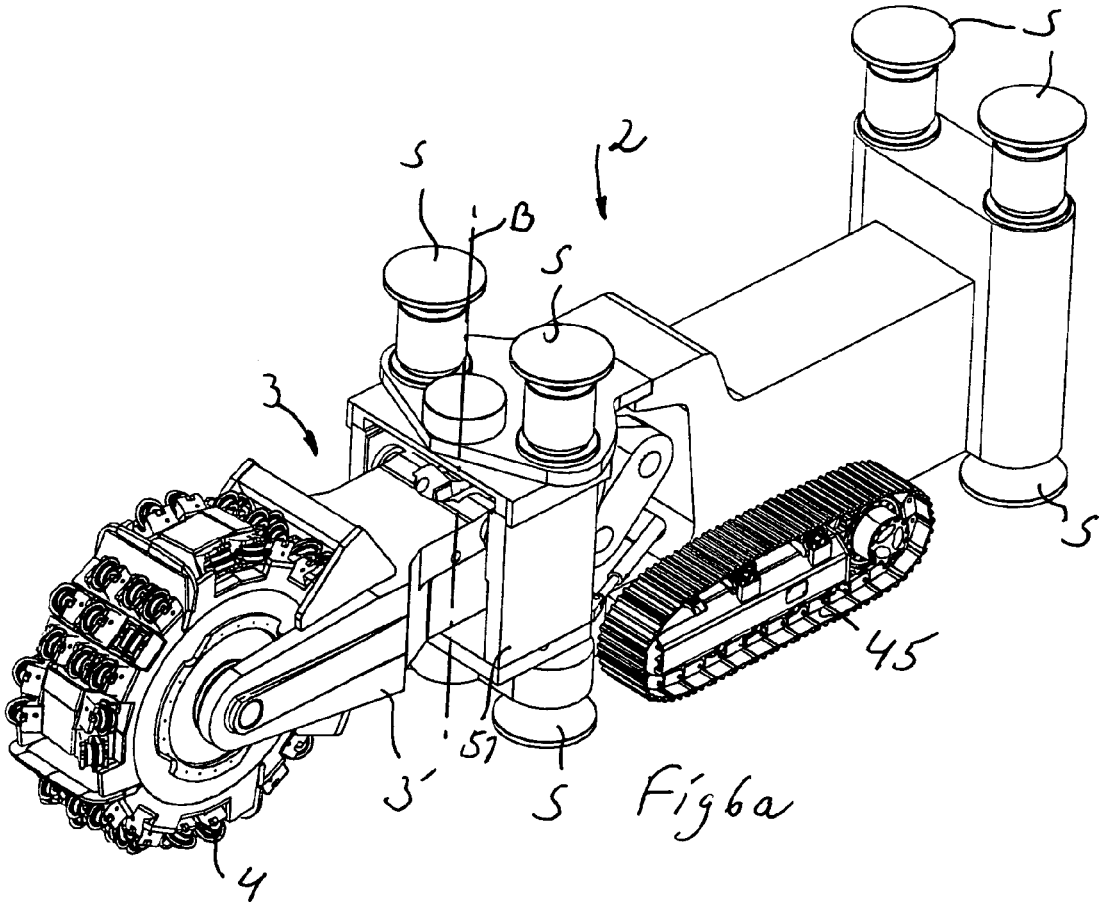
FIGS. 6*a-c* shows a rig according to a further embodiment in different views.
Figure 6B:
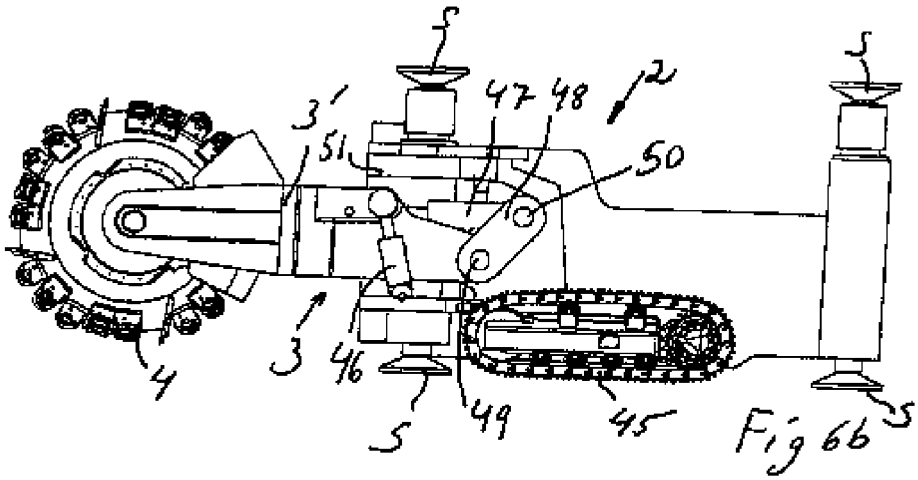

In FIG. 6*a* is shown a device according to the invention in a further embodiment, wherein a base unit 2 is equipped with crawler bands 45 and two pairs of stabilizing units S for pressing against the roof of a gallery or the like being driven in a rock material and two pairs of stabilizing units S intended to be active against a floor of said gallery. A cutting head 4 is arranged at the front end of the carrying unit 3 with a carrying boom 3', wherein the carrying unit 3 is swingable around the vertical axis B, that is from side to side of the gallery of the tunnel to be taken up in the rock. In FIG. 6*b* the device in FIG. 6*a* is shown with certain details removed for better illustration of the suspension of the carrying unit 3 on the base unit 2. The boom 3' is pivotally supported at a pivot point 49 on an end of a link 48, which with its second end is pivotal around a pivot shaft 50, which is connected to a chassis portion of the carrying unit 3, said chassis portion 51 being swingable around said vertical axis B. A lifting cylinder is indicated with 46 and acts in lifting direction of the boom 3' and thereby of the cutting head 4. A pressing cylinder being part of a pressing unit is indicated with 47 and is intended to press the cutting head 4 against the rock side to be worked with the cutting head 4.

Figure 6C:
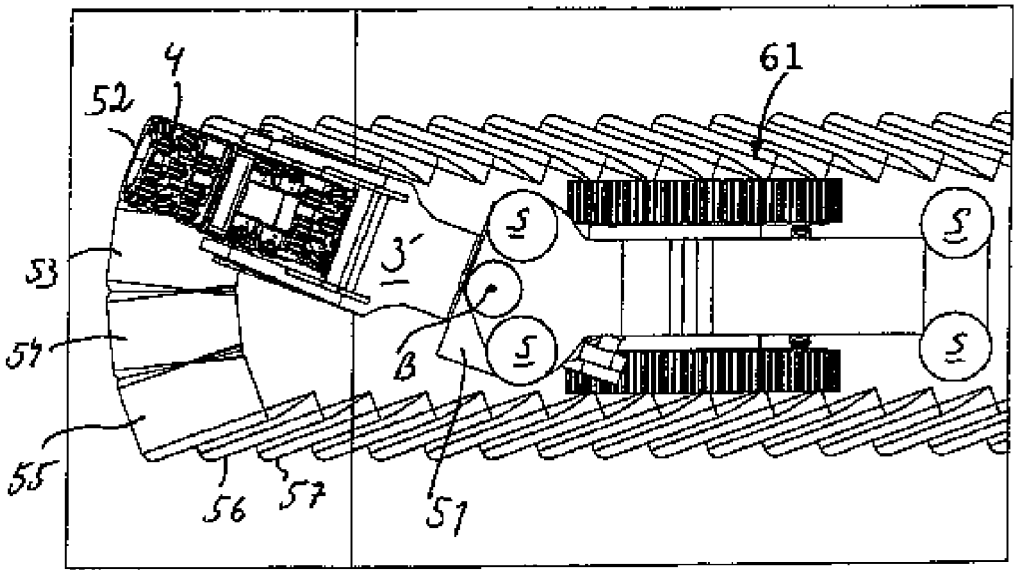

FIG. 6 *c* shows the device in FIGS. 6*a* and 6*b* as seen from the above during the process of drifting a gallery or a tunnel in rock. The boom 3' is here shown swinging outwardly and sidewardly in an outmost position of this application, and in the process of working rock in a section 52. On the Figure there are shown previous made cuts in the rock 53, 54 and 55 as well as a great number of side edges 56 and 57 of previous cuts made in the rock. Altogether with a device according to FIG. 6*a-c*, a tunnel is formed with relatively plane floor and roof but with somewhat irregular side walls 61 because of the way of carrying out the method in this application.

Figure 7F:
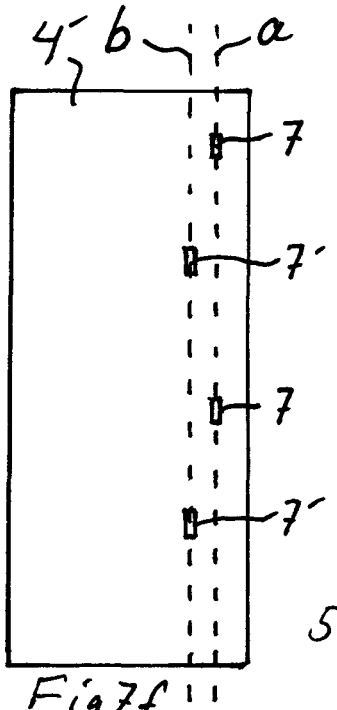
FIG. 7*f* shows diagrammatically the envelope surface of a cutting head in a laid out view.
Figure 7:
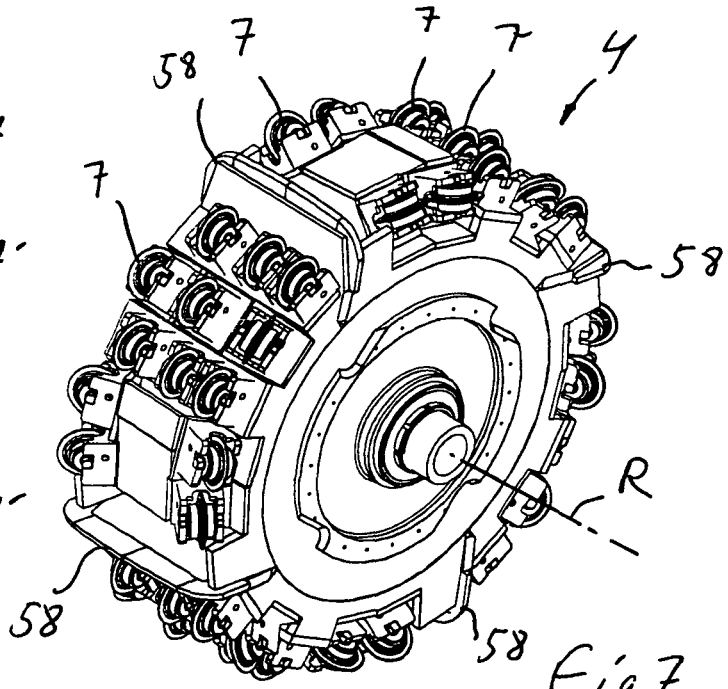
FIG. 7 shows a cutting head in a perspective view.

In FIG. 7 is shown a cutting head 4, which has a great number of cutting rolls 7 distributed in the circumferential direction and in axial direction of the cutting head 4. In this case there are cutting rolls 7 with axes parallel to the general axis of rotation R for the cutting head 4 as well as a number of cutting rolls 7, the rotational axes of which forming an angle with the general axis of rotation R. Further, the cutting head 4 has four material scrapers 58 distributed around its periphery for assisting in loosening partly stuck rock material. The material scrapers 58 are suitably manufactured from a conventional material which is used for corresponding use in connection with scraper machines etc.

Figure 7C:
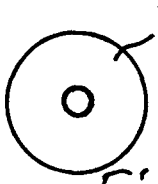
FIGS. 7*a-e* show diagrammatically views of alternative cutting rolls.
Figure 7B:
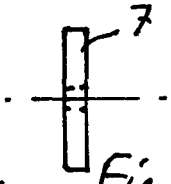
Figure 7A:
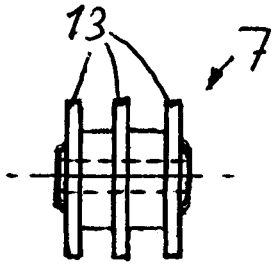

In FIG. 7*a* is shown a variant wherein a cutting roll 7 is constructed with combined sidewards arranged rock cutting elements 13 in the form of radially extending disc portions having essentially circular circumference. This can be true for at least a part of rock cutting elements 13 on a cutting head and the number of rock cutting elements 13 on a cutting roll can vary.

Figure 7E:
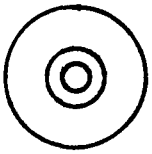
Figure 7D:
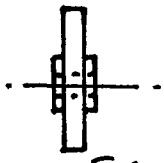

In FIGS. 7*b* and 7*c* is shown a usual variant of a cutting roll 7 which is shaped as a plane circular cylindrical disc with a central through hole for a roll shaft (not shown). FIGS. 7*d* and 7*e* show a further variant of a cutting roll 7, wherein the cutting roll has a peripheral disc shaped portion and centrally, a hub portion extending on either side of the disc shape and with a hole for a roll shaft.

In FIG. 7*f* there is diagrammatically shown an imaginary laid out envelope surface 4' in two dimensions of a cutting head (such as 4 in FIG. 7) in a diagrammatic part representation. The height in the Figure corresponds thus to the peripheral circumference of the cutting head and the width in FIG. 7*f* the axial width of the cutting head. With the dotted lines a and b respectively are indicated two of a plurality (all not shown) different axial levels of a cutting head 4 shown on the laid out envelop surface 4'. FIG. 7*f* illustrates that two cutting rolls are active on the same axial level two cutting rolls 7 are active on the axial level a, and two cutting rolls 7' are active on level b. This means that during operation of rig with a cutting head 4, two cutting rolls will act for forming one and the same groove, which increases the working speed of the device. It is also possible to have more than two cutting rolls acting in the same groove.

Figure 8:
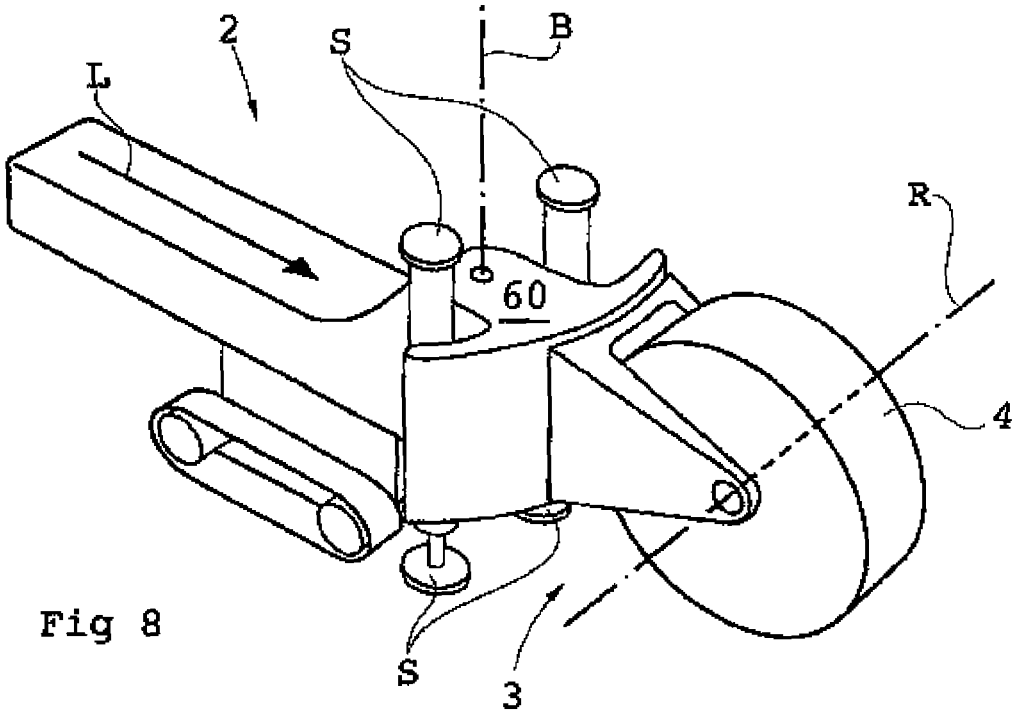
FIG. 8 shows a rig according to a further embodiment in a perspective view.

In FIG. 8 is shown a further embodiment of the invention for working essentially horizontally for driving tunnels, galleries or the like. A base unit 2 supports a cutting head 4 over a carrying unit 3, which is displaceable around a side swinging device around a vertical axis B in a manner corresponding to what is stated above. The machine according to FIG. 8, however, differs from for example the machine in FIGS. 6*a*-6*c* on one important point in that the cutting head 4 is not pressed into the rock at the right angle to the general axis of rotation R of the cutting head 4 but that a forward driving arrangement for the cutting head is arranged to act in a length direction L of the base unit 2 through one or more sufficiently powerful dimensioned hydraulic cylinders or in any other way, for example by way of a link system multiplying force. Activating of a forward driving device this way means that the cutting head 4 in swinged-out positions will be moved forward somewhat obliquely in respect of its general axis of rotation, wherein the cutting rolls in one and the same group will follow roll paths that somewhat deviate from a path taken by a roll that has already performed a groove depression in the rock material. The deviation will, however, be small because of the geometry and because of that it is suggested a smaller outward swinging of the cutting head during such drifting, usually close to 15° deviation from the length direction L of the machine and from the general extension of the tunnel or gallery, but also with up to about 20° outward swing. This corresponds to applying the cutting head with an angle of between 19° and up to 70° angle to the general axis of rotation R of the cutting head 4.

Figure 9:
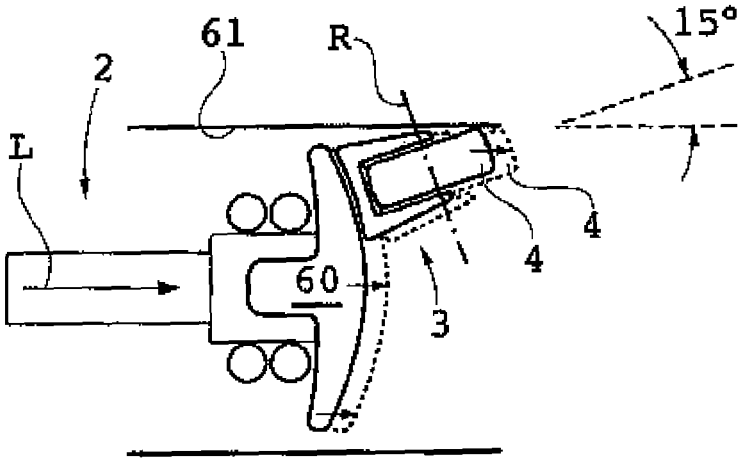
FIG. 9 shows diagrammatically the rig in FIG. 8 in operation.
Figure 10:
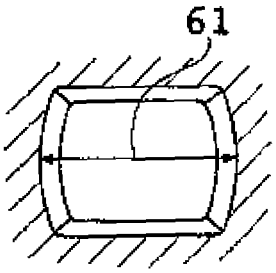
FIG. 10 shows diagrammatically a section of a tunnel or a gallery made by the rig in FIGS. 8 and 9, FIGS. 11*a-c* and 12-14 show a rig according to a further embodiment in different positions and different views.

In FIG. 9 this is illustrated through indication of that the supporting unit 60, which carries a carrying unit 3 equipped with the cutting head 4, can be pressed forward from the position shown with full lines to the position shown with interrupted lines, wherein the cutting head 4 also will come into the position indicated with interrupted lines. The rock side 61 hereby gets a relatively even, and somewhat rounded shape as seen in a cross section, see the diagrammatic sketch in FIG. 10. If greater height of the tunnel is required than what corresponds to the diameter of the cutting head, the device/the rig in FIG. 8 can be angled upwardly in relation to the floor during working at higher levels. Hereby the roof will get a serrated configuration corresponding to the walls in FIG. 6*c*.

Figure 11A:
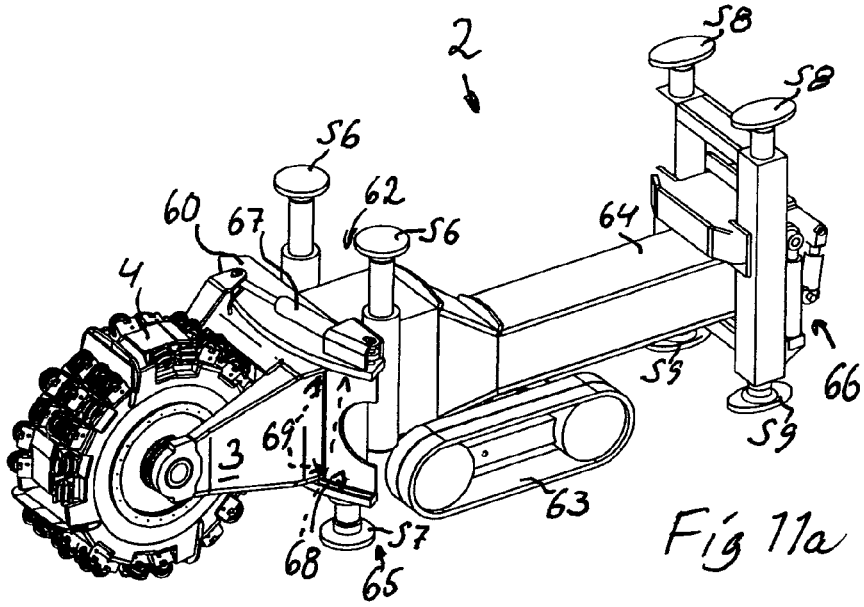
Figure 11B:
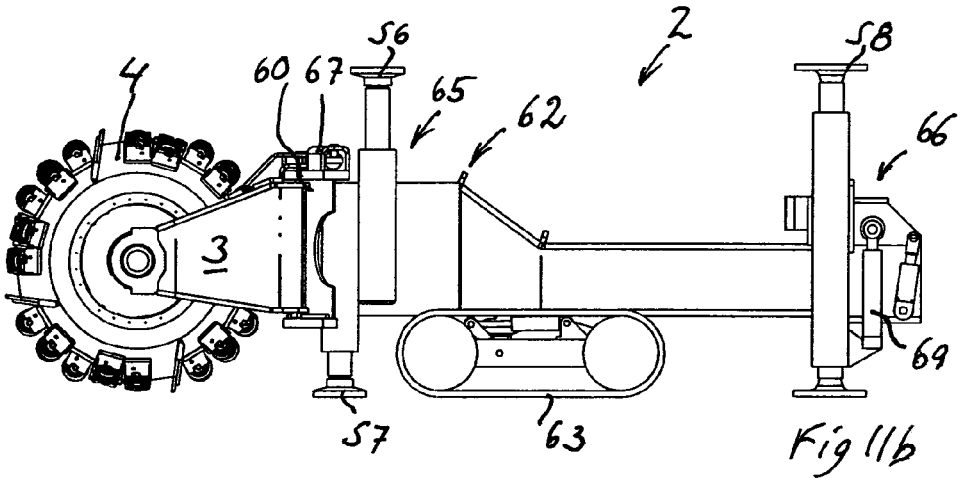
Figure 11C:
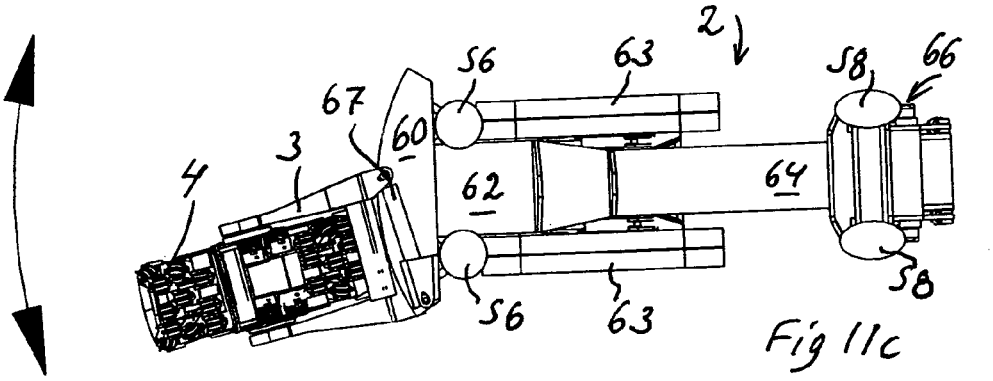

In FIGS. 11*a-c* is shown a rig for driving tunnels, galleries and the like, which in principle functions as the one shown in FIGS. 8 and 9. In the following description relating to FIGS. 11*a, b, c*, 12, 13 and 14 such a rig is described in more detail.

The base unit 2 has a forward supporting unit 60, which has a front with a partly circular cylindrical portion for allowing angular displacement and side displacement of a cutting head 4 over a carrying unit 3. The carrying unit 3 is supported by the supporting unit 60 over a combination of part circular guide grooves 68 on the upper and lower part of the support unit 60, said guide grooves 68 being directed towards each other. The carry unit 3 has (not shown) guide elements indicated with broken arrows 69 in FIG. 11*a*. These guide elements 69 which can be comprised of for example rolls or pins or blocks, engage in and slide or roll in said guide grooves 68 in order to guide the carrying unit 3 along a partly circular path when actuating a turning device 67. The turning device 67 which in the Figures is in the form of hydraulic cylinder, is at its one end fastened to an edge of the supporting unit 60 and at its other end at an engagement ear integrated to the carrying unit 3.

The base unit 2 has a forward base portion 62 wherein is integrated a pressing unit for displacement of the supporting unit with supported cutting head 4 in a length direction of the base unit 2. The base unit 2 further has a rear base portion 64 which is lockable displaceable in a rear stabilizing arrangement 66, which in turn has stabilizing units S8 and S9 for engagement with roof and floor in a tunnel, gallery or the like. Further, a forward stabilizing arrangement 65 has stabilizing units S6 and S7, likewise or engagement with roof and floor in tunnel, gallery or the like.

The rig in these Figures is mobile and has a propulsive arrangement which by inactivated stabilizing units S6-S9 can move the rig in a length direction.

FIG. 11*b* shows the rig in a side view and in FIG. 11*c* in a view from above, whereof clearly is shown that the carrying unit 3 with supported cutting head 4 is angled from a central position to a side position. Compare this to the aforementioned description of FIGS. 8 and 9.

Figure 12:
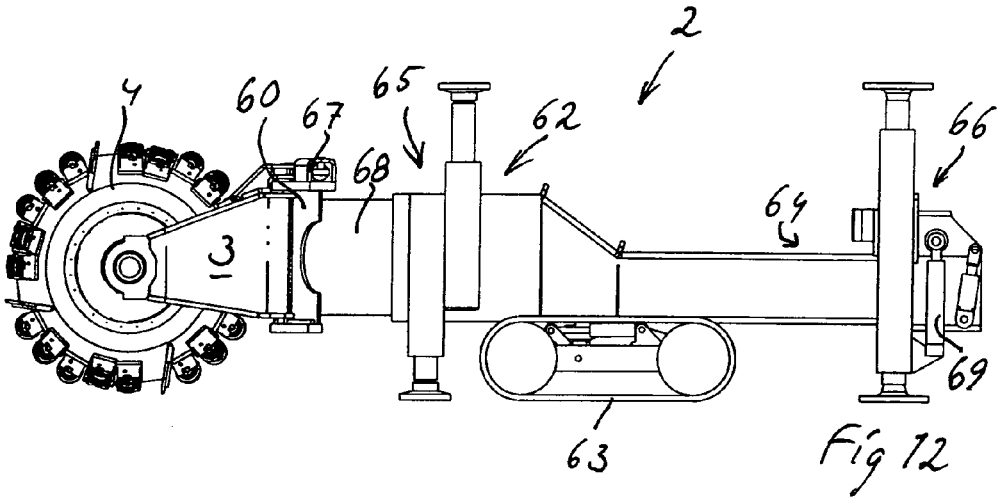

In FIG. 12 is shown the rig in FIGS. 11*a-c* in a second position, wherein the pressing unit being included in the forward base portion 62 has pressed the support unit 60 with supported cutting head 4 in a forward direction so far that an inner telescopic portion 68 of said pressing unit is shown. As drive means for a pressing unit can be used powerful hydraulic cylinders, a multiplying link system or the like which can be contained inside the base unit 2.

In the position shown in FIG. 12 is in principle shown the pressing unit 62 with the support unit 60 with supported cutting head 4 in a maximally forward driven position. It is of course understood that working is made successively under successive forwarding of the cutting head 4 during its rotation in a continuous manner.

Figure 13:
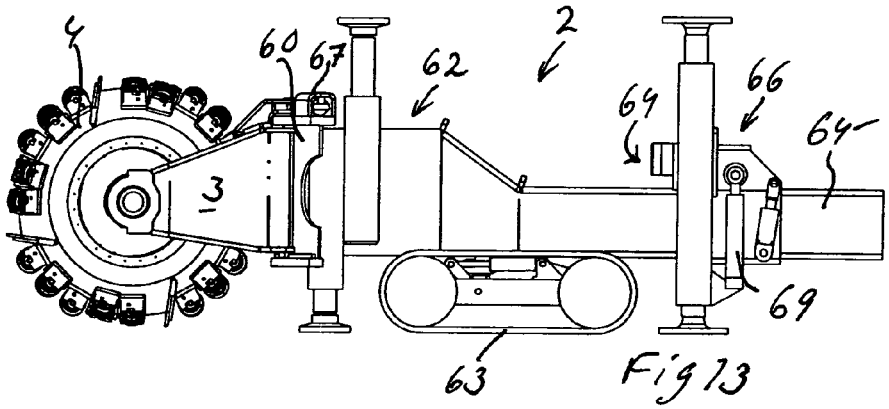

In FIG. 13 there is shown the rig in FIGS. 11*a-c* and 12 in a further position, wherein the rear base portion 64 has been reversed through the rear stabilizing arrangement 66 such that an end part thereof, 64' extends beyond this rear stabilizing arrangement 66 as seen in a working direction. This position allows radically backwardly displaced cutting head from a drive place, which can be advantageous for example when space is needed in front of the rig for different types of work to be performed in this position.

Figure 14:
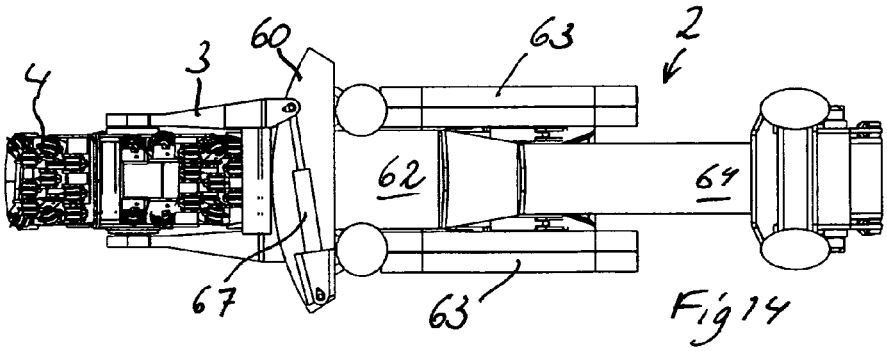

In FIG. 14 is shown a position of the rig with the carrying unit 3 with supported cutting head 4 in a direction in line with a length direction of base unit 2. From this position, thereupon a carrying unit with supported cutting head 4 can be displaced on the support unit 60 to a position when the cutting head 4 is brought aside and angled to the right, as seen in a working direction of the rig (not shown). Hereby full width of a tunnel or gallery in question can be worked through three positions that are angled in respect of each other.

Referring again to FIG. 13, from this picture it is clear that worked height of the cutting head 4 is below the present height of a tunnel or gallery in question, which in stead roughly seen corresponds to a distance between the outer portion of the stabilizing units S6 and S7 and S8 and S9, respectively, which in fact outermost have contact plates for engagement with rock.

In order to make it possible to work on the entire height of a tunnel, the base unit 2 can be raised in respect of the floor in such a way that the lower stabilizing units S7 are pressed outwards and the upper stabilizing units S6 are allowed to be pressed in corresponding to this measure and that the lifting cylinder 69 in the rear stabilizing arrangement 66 is activated for pressing upwards of the rear base portions 64 of the base unit 2 in the corresponding degree. Hereby the cutting head 4 can be lifted to a height corresponding to a desired roof level, whereupon drifting continues in the same way as is explained above.

In a modified variant of the rig being shown in FIGS. 11*a-c* and 12-14 the part of the base unit 2 being supported by stabilizing units is rotatable about an axis which extends in the length direction of the base unit 2. Hereby the unit essentially being comprised of the front and rear base portions 62 and 64, support unit 60, carrying unit 3 and cutting head 4 can be rotated 90° in respect of what is shown in these Figures.

Figure 15:
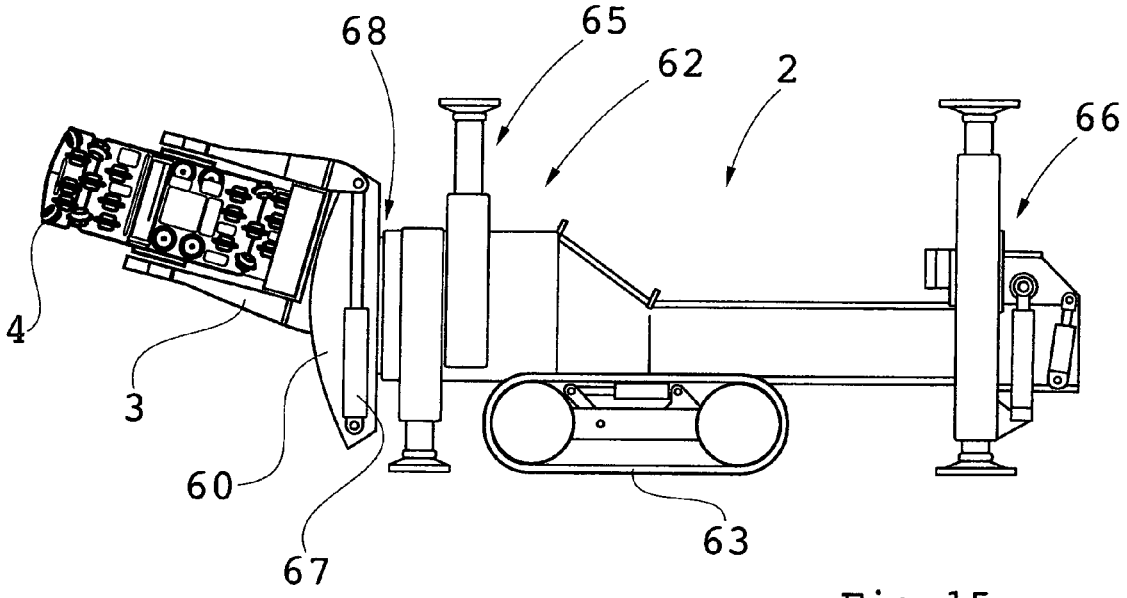
FIG. 15 shows a rig according to a further embodiment in a position where the support unit is elevated and rotated 90°.

Another variant on this aspect is shown in FIG. 15, wherein is illustrated that the support unit 60 instead has been rotated 90° in respect of the base unit 2.

Figure 16:
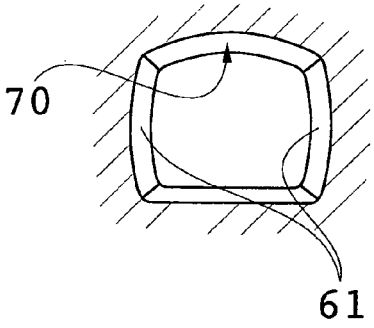
FIG. 16 shows diagrammatically a section through a tunnel or a gallery produced by the rig in FIG. 15.

Hereby the cutting head 4 can be brought to act against the roof of the tunnel or gallery in a state where it is lifted and with the carrying unit 3 and the cutting head 4 in an upwards angled state such that there results a vaulted shape on this roof, which is illustrated with 70 in FIG. 16, and which is advantageous for the resistance of the resulting tunnel or gallery. It should be noted that stabilizing arrangements 65 and 66 are shown with their stabilizing units positioned in a low position of the rig and that normally the rig is arranged for action with the cutting head 4 for producing the vaulted shape of the roof with the rig in an uplifted position according to what is stated above.

The invention can be varied within the scope of the claims and for example the working rig 1 in FIGS. 1*a*-1*b* as well as the rig in FIGS. 3*a-c* can be provided with a varying number of carrying units with supported cutting heads 4. For example, the rig in FIG. 1*a* can be provided with two or even more carrying units with associated cutting heads 4, and the rig in FIGS. 3*a-c* be provided with for example three or four carrying units being distributed around the central axis. Compare FIGS. 5*a-c*.

By the device according to the invention the operational area can be simply varied to its extent, which can be easily achieved by varying swinging outwardly respectively at occasions rotation of the respective carrying unit 3 a suitable angle. In particular the invention can advantageously be adapted for very great cavity room dimensions.

The cutting heads can be shaped otherwise in respect of what is shown in the Figures. Thus, the cutting heads can be constructed thinner or broader compared to its diameter than what is shown. The rock cutting element on cutting rolls can be arranged otherwise, either with holders or separate rock cutting elements such that axially at the same level lying elements form a group or with several rock cutting elements on one respective cutting roll, such that each cutting roll includes rock cutting elements within plural groups, wherein with a group is intended rock cutting elements acting in and for making one and the same groove, see FIG. 7*a*.

Driving of the cutting head can be obtained in a per se known manner, for example through hydraulic means such that a hydraulic driving device is positioned in the carrying unit.

The dimension of the rock cutting elements is suitably such at their width in a radially outermost portion intended to penetrate into the rock is as an example about 8-25 mm and their diameter can be about 200-500 mm. Depending on the hardness of the rock and the used pressing power, the rolls normally penetrates from about 3 to about 12 mm. The rolls are arranged such that the produced grooves are formed with a separation of 50-120 mm, which, as is stated above, depends on the rigidity of the rock, its susceptibility or forming cracks etc.

Cutting heads according to the invention can have very great dimensions with diameters up to and even exceeding 4 meters. Cutting head width can than be, as an example, about 1 meter. The driving effect of the cutting head in such a case need to be up to, as an example, 1400 kW for hard rock with a rotational speed of from a few rotations per minute through about 20 rpm. As further not limiting example, the telescopic power can amount to 200 tons and the swing force to about 150 tons.

The following alternative features of the invention can be combined freely after need and application.

When driving is made vertically downwardly, vertical upwardly directed forces from the drifting are suitable brought to be balanced against the gravity force acting on the equipment.

It is normally suitable that the rotating cutting head 4 is pressed in a direction essentially at a right angle to the general axis of rotation against a rock surface to be worked. The invention, however, also includes the advantageous variant with pressing the cutting head obliquely against said rock surface as is stated above.

Material being loosened because of cutting of the grooves is transported away suitably through per se known arrangements associated with the rig. Between the cut grooves existing and partly stuck material can be loosened, preferably through mechanical action and be transported away. Worked material is transported away, suitably through an opening axially through the driving device.

The cutting head has suitably holders for the cutting rolls in the form of essentially radially from a main body of the cutting head 4 extending fastening ears 8 with shaft holes. A cutting head according to the invention preferably has material scrapes 58 preferably in the area of the cutting rolls 4 for loosening partly stuck rock material. The cutting head further has suitably a centrally through drive axis for cooperation with drive means of the carry unit 3. The cutting rolls are preferably distributed such that over the circumference of the cutting head, two or more cutting rolls are positioned on the same axial level and thereby in operation cutting in the same groove.

A device for driving tunnels, galleries, shaft of the like, includes a carrying unit 3 for carrying, rotation and displacing cutting head 4 in accordance with the invention. This device suitably has in particular one carrying boom 5, a rotation unit for rotation of the cutting head 4 around a rotational axis R and a swing joint 6 and a swing motor 11 for swinging the carrying boom 5 with supported cutting head in respect of a base unit in directions at a right angle to the general axis of rotation. The carrying boom 5 is preferably extendable, suitably telescopic and includes an extension motor 10. Altogether, the carrying unit 3 is suitably constructed modularly.

In a rig according to the invention, the base unit 2; 15 can suitably include a swing unit for each carrying unit 3 for swinging the respective carrying unit 3 around a swing axis B which is at an angle to the pivot axis 4 of the respective carrying unit.

In a rig according to the invention, the base unit is preferably a mobile vehicle and includes stabilizing units for stabilizing engagement with at least one from the group: a floor, a first side wall, a second side wall, a roof.

When the rig has a base unit including a plurality of carrying units, the carrying units 3 are suitably evenly distributed around a central axis C of the base unit 15 for allowing swinging of the carrying units around their respective swing axes. The base unit 15 is then preferably mobile forward stepwise through mutually displaceable stepping units 24, 25 each one having a plurality or stabilizing units SA, SB; S, which are distributed around the central axis C and which are active radially outwardly therefrom. The base unit 15 thereby suitably has an axial through opening for transporting away worked material.

The invention claimed is:

1. Method for driving tunnels, galleries, or shafts with a driving device, the steps of said method including:

applying a cutting head rotating around a general axis of rotation and having rock cutting elements directed essentially radially outwardly against a rock surface to be worked, and removing material loosened through cutting, bringing the rock cutting elements, which are formed as at least peripherally disc-shaped cutting rolls, to roll against the rock surface when the rotating cutting head is pressed against the rock, wherein the rock cutting elements during rolling are brought to cut parallel and spaced grooves in the rock surface, wherein i) in a first driving phase, pressing the cutting head against the rock by displacing the cutting head linearly in a driving direction against rock to be worked in a complete cut, ii) after a completed driving phase, withdrawing the cutting head away from the rock in an opposite linear direction, displacing it to a position with new rock to be worked, iii) in a subsequent driving phase, pressing the cutting head against the new rock by displacing the cutting head linearly in a new driving direction against the new rock to be worked in a new complete cut, and repeating the aforementioned steps i)-iii) as required to complete a tunnel, gallery or shaft.

2. Method according to claim 1, wherein the rotating cutting head is pressed against the rock in a direction which forms an angle between about 70° and 90° relative to the general axis of rotation against the rock surface to be worked.

3. Method according to claim 1, wherein the grooves are formed with such separation that rock material being present between the grooves predominately will be split off by itself, because of self induced cracking in the material during groove cutting.

4. Method according to claim 1, wherein the parallel and spaced grooves are formed with a separation of between 50-120 mm.

5. Method according to claim 4, wherein the rotating cutting head is pressed against the rock in a direction which forms an angle of between about 70° and 90° relative to the general axis of rotation against the rock surface to be worked.

6. Method according to claim 1, wherein, during a driving phase, the cutting head is pressed into the rock at a right angle relative to the general axis of rotation of the cutting head.

7. Method according to claim 1, wherein, during a driving phase, the cutting head is pressed into the rock in a lengthwise direction of a base unit of a rig for driving tunnels including said driving device.

* * * * *